US010352532B2

(12) United States Patent
Catalano

(10) Patent No.: US 10,352,532 B2
(45) Date of Patent: Jul. 16, 2019

(54) UNIFORM LIGHT SOURCE WITH VARIABLE BEAM DIVERGENCE

(71) Applicant: LEDVANCE LLC, Wilmington, MA (US)

(72) Inventor: Anthony W. Catalano, Boulder, CO (US)

(73) Assignee: LEDVANCE LLC, Wilmington, MA (US)

( * ) Notice: Subject to any disclaimer, the term of this patent is extended or adjusted under 35 U.S.C. 154(b) by 92 days.

(21) Appl. No.: 14/973,532

(22) Filed: Dec. 17, 2015

(65) Prior Publication Data

US 2016/0178142 A1 Jun. 23, 2016

Related U.S. Application Data

(60) Provisional application No. 62/093,135, filed on Dec. 17, 2014.

(51) Int. Cl.

| | |
|---|---|
| ***F21V 13/00*** | (2006.01) |
| ***F21V 7/08*** | (2006.01) |
| ***F21V 7/06*** | (2006.01) |
| ***F21V 14/02*** | (2006.01) |
| ***F21V 14/04*** | (2006.01) |
| *F21Y 105/10* | (2016.01) |
| *F21Y 115/10* | (2016.01) |

(52) U.S. Cl.

CPC ..... *F21V 7/08* (2013.01); *F21V 7/06* (2013.01); *F21V 14/02* (2013.01); *F21V 14/04* (2013.01); *F21Y 2105/10* (2016.08); *F21Y 2115/10* (2016.08)

(58) Field of Classification Search

CPC ... F21V 7/08; F21V 7/06; F21V 14/02; F21V 14/04; F21K 9/62

USPC ..... 362/296.05

See application file for complete search history.

(56) References Cited

U.S. PATENT DOCUMENTS

| | | | | |
|---|---|---|---|---|
| 7,942,556 | B2 * | 5/2011 | Harbers | F21V 17/02 362/294 |
| 2009/0103293 | A1 * | 4/2009 | Harbers | F21V 9/40 362/231 |
| 2011/0063824 | A1 * | 3/2011 | Qiu | F21L 4/027 362/188 |
| 2011/0170289 | A1 * | 7/2011 | Allen | F21V 13/12 362/235 |

(Continued)

*Primary Examiner* — Andrew J Coughlin

(74) *Attorney, Agent, or Firm* — Neugeboren O'Dowd PC

(57) ABSTRACT

A light source producing a beam of variable divergence, comprising one or more light-emitting devices arranged on a planar substrate, with each of the light-emitting devices having a Lambertian emission distribution. The light source may further comprise a chamber for mixing light emitted from the one or more light-emitting devices, the chamber itself comprising a base defined by the planar substrate, one or more side walls having a reflective interior surface, and a planar diffusive emission surface defining a ceiling of the chamber. The chamber may have an adjustable height. A reflector extends from the chamber for redirecting light exiting from the chamber to form a light beam, the reflector surrounding and having a focal plane coincident with the ceiling of the chamber. Finally, the light source may comprise a mechanism to control a height of the chamber to thereby variably control a divergence of the light beam.

17 Claims, 12 Drawing Sheets

(56) References Cited

U.S. PATENT DOCUMENTS

| | | | | |
|---|---|---|---|---|
| 2012/0218744 | A1* | 8/2012 | Popper | F21V 14/025<br>362/184 |
| 2013/0294066 | A1* | 11/2013 | Niina Lillelund | G02B 6/0008<br>362/232 |
| 2014/0084809 | A1* | 3/2014 | Catalano | H05B 33/0845<br>315/292 |

* cited by examiner

UNIFORM LIGHT SOURCE WITH VARIABLE BEAM DIVERGENCE

CLAIM OF PRIORITY UNDER 35 U.S.C. § 119

The present application for patent claims priority to Provisional Application No. 62/093,135 entitled "UNIFORM LIGHT SOURCE WITH VARIABLE BEAM DIVERGENCE" filed Dec. 17, 2014, and assigned to the Assignee hereof, the entire contents of which are hereby expressly incorporated by reference herein.

TECHNICAL FIELD

The present invention relates to illumination devices including adjustable light sources with a mixing chamber for providing uniform illumination.

BACKGROUND

Light-emitting diodes (LEDs), particularly white LEDs, have increased in size in order to provide the total light output needed for general illumination. As LED technology has advanced, the efficacy (measured in lumens/Watt) has gradually increased, such that smaller die now produce as much light as was previously created by emission from far larger die areas. Nonetheless, the trend favoring higher light outputs has led to larger semiconductor LED die sizes, or, for convenience, arrays of smaller die in series or series-parallel arrangements. Series arrangements are generally favored because the forward voltage of LEDs varies slightly, resulting, for parallel arrangements, in an uneven distribution of forward currents and, consequently, uneven light output.

Ordinary light sources commonly have a fixed light-distribution pattern that cannot be modified by the user. The beam angle of the light emanating from the light source depends on the intended application; in the retail marketplace, for example, "spotlights" refer to narrow-beam sources while "floodlights" illuminate over a wide area. While the technology for varying beam angle is well known, the resulting systems tend to be too costly or inefficient for consumer use. Movable refractive optics, for example, can be used to alter beam angle as the position of a lens is varied. But the acceptance angle of such optical systems varies with position, so the efficiency decreases as the beam angle is altered. Moreover, because multiple optical surfaces are required, light losses can quickly mount as additional optical elements are added. Preventing color separation, distortion and other artifacts may require still further optical features.

Yet the ability to vary beam angle may be desired in various applications where expensive optical systems would not be cost-justified. A merchant, for example, may wish to vary the output of the same display light source to illuminate an array of objects or a single, small object. A need, therefore, exists for cost-effective light sources that produce variable beam angles with uniform illumination and without sacrificing beam quality.

SUMMARY

One aspect of the present disclosure provides a light source producing a beam of variable divergence. The light source may comprise one or more light-emitting devices arranged on a planar substrate, with each of the light-emitting devices having a Lambertian emission distribution. The light source may further comprise a chamber for mixing light emitted from the one or more light-emitting devices, the chamber itself comprising a base defined by the planar substrate, one or more side walls having a reflective interior surface, and a planar diffusive emission surface defining a ceiling of the chamber. The chamber may have an adjustable height. Further, the light source may comprise a reflector extending from the chamber for redirecting light exiting from the chamber to form a light beam, the reflector surrounding and having a focal plane coincident with the ceiling of the chamber. Finally, the light source may comprise a mechanism to control a height of the chamber to thereby variably control a divergence of the light beam.

Another aspect of the disclosure provides a light source comprising one or more light-emitting devices arranged on a planar substrate and a chamber for mixing light emitted from the one or more light-emitting devices, the chamber comprising a base defined by the planar substrate, one or more side walls having a reflective interior surface, and a planar diffusive emission surface defining a ceiling of the chamber, wherein the base is movable in relation to the ceiling. The light source may also comprise a reflector extending from the chamber for redirecting light exiting from the chamber to form a light beam, the reflector surrounding and having a focal plane coincident with the ceiling of the chamber.

Yet another aspect of the disclosure provides an adjustable light source for producing a light beam of variable divergence. The light source may include one or more light-emitting devices arranged on a reflective substrate. The light source may further comprise a chamber for mixing light emitted from the one or more light-emitting devices, the chamber itself comprising a base defined by the reflective substrate, one or more side walls having a reflective and flexible interior surface, and a diffusive emission surface defining a ceiling of the chamber, wherein the distance between the base and the ceiling is adjustable. The adjustable light source may also comprise a reflector extending from the chamber for redirecting light exiting from the chamber to form a light beam, the reflector surrounding and having a focus coincident with the ceiling of the chamber. Finally, the adjustable light source may comprise a mechanism for adjusting the distance between the base and the ceiling, wherein adjusting the distance changes the divergence of the light beam.

DETAILED DESCRIPTION

Embodiments of the present disclosure provide light sources that include an arrangement of LEDs and a light mixing chamber having a variable height; the height of the mixing chamber and other optical parameters collectively determine the output light distribution.

Embodiments of the disclosure exploit the fact that the light distribution of LEDs varies in intensity with the cosine of the angle measured from the central optical axis perpendicular to the plane of the LED emitter. This cosine variation, also known as a Lambertian distribution, is illustrated in the polar plot 100 of FIG. 1 for a typical LED, with the central optical axis 110 depicted in the middle.

An important feature of the distribution is that the light output of an LED decreases rapidly as the angle increases from 0° to 90° (normal to the optical axis). This dependence of intensity I on angle can be written as, $$I=I_0 \cos n\Phi$$

where $\Phi$ is the angle measured from the optical axis, n is a number indicative of the width of the light distribution (higher values indicate a narrow distribution), and $I_0$ is the maximum intensity at $\Phi=0$.

Figure 2:
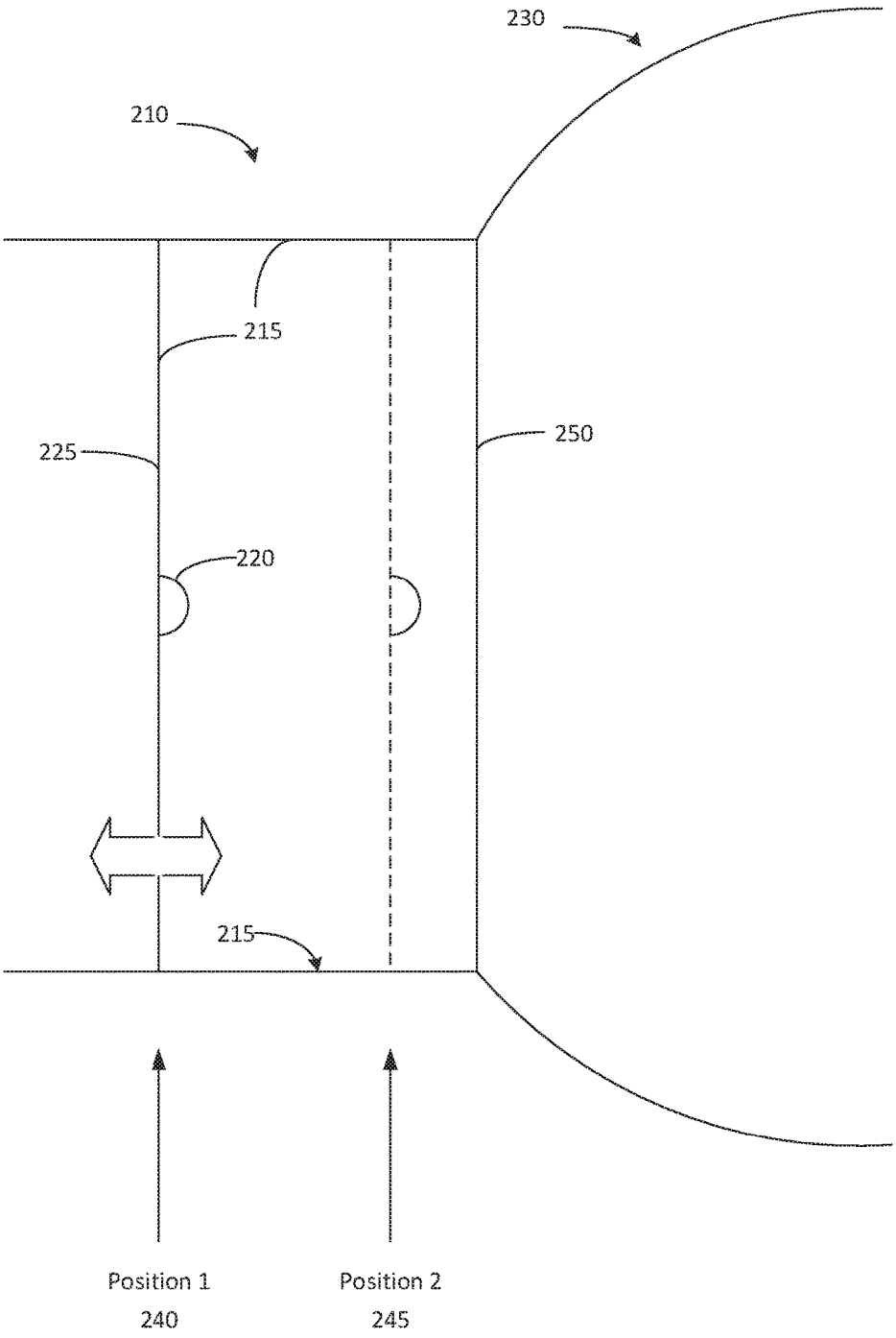
FIG. 2 is a side cross-section view of a light mixing chamber containing an LED light and a coupled reflector, with a base of the light mixing chamber being shown in two alternate positions.

In various embodiments, the present disclosure includes a light mixing chamber and a coupled reflector. With reference to the representative embodiment shown in FIG. 2, the mixing chamber 210 may contain within its volume one or more LED light sources 220 mounted on a base or floor 225. In the embodiment shown, one or more of the interior surfaces 215 of the mixing-chamber walls may be highly (i.e., at least 90%) reflecting; this surface may be either specularly reflecting or diffusely reflecting. Advantages of the reflective properties of the surface will be discussed later in this disclosure. In various embodiments, the mixing chamber may be cylindrical, as shown in FIG. 2, with the base 225, the reflective surface 215, and exit screen 250 forming the sides of the cylinder. The view in FIG. 2 is shown from a side cross section of the cylinder, which is illustrated by the base 255, the upper and lower portions of the reflective surface 215, and the exit screen 250 forming a "rectangle." It is contemplated that in some embodiments, the light source 220 could comprise a linear parabolic reflector and LED arrangement within a rectangular cubic light mixing chamber rather than a cylindrical one. In such an embodiment, the view along the optical axis would appear rectangular. The various embodiments illustrated throughout the disclosure may be thought of as either cylindrical, cubical, or polygonal.

The exit screen 250 in the embodiment shown is a transmissive material that lies in the focal plane of the reflector 230 to which it is attached. Throughout the present disclosure, the exit screen 250 may be referred to as a "diffuse screen," a "transmissive screen," or a "transmissive ceiling." The distance between the LED(s) 220 and the transmissive ceiling 250 is desirably adjustable. FIG. 2 shows the base 225 and the LED 220 in two different positions: a first position 240 shows the LED 220 further away from the transmissive ceiling 250 than it is in the second position 245. Because the exit screen 250 lies in the focal plane of the reflector 230, the LED-to-exit distance directly determines the resulting output beam angle of the light that ultimately exits the reflector 230. In general, and for a given reflector design, the output beam angle of the light sources will increase as the distance between the LED(s) and the exit screen increases. Therefore, the output beam angle of the light exiting the reflector 230 may be greater at the first position 240 than at the second position 245.

Figure 2A:
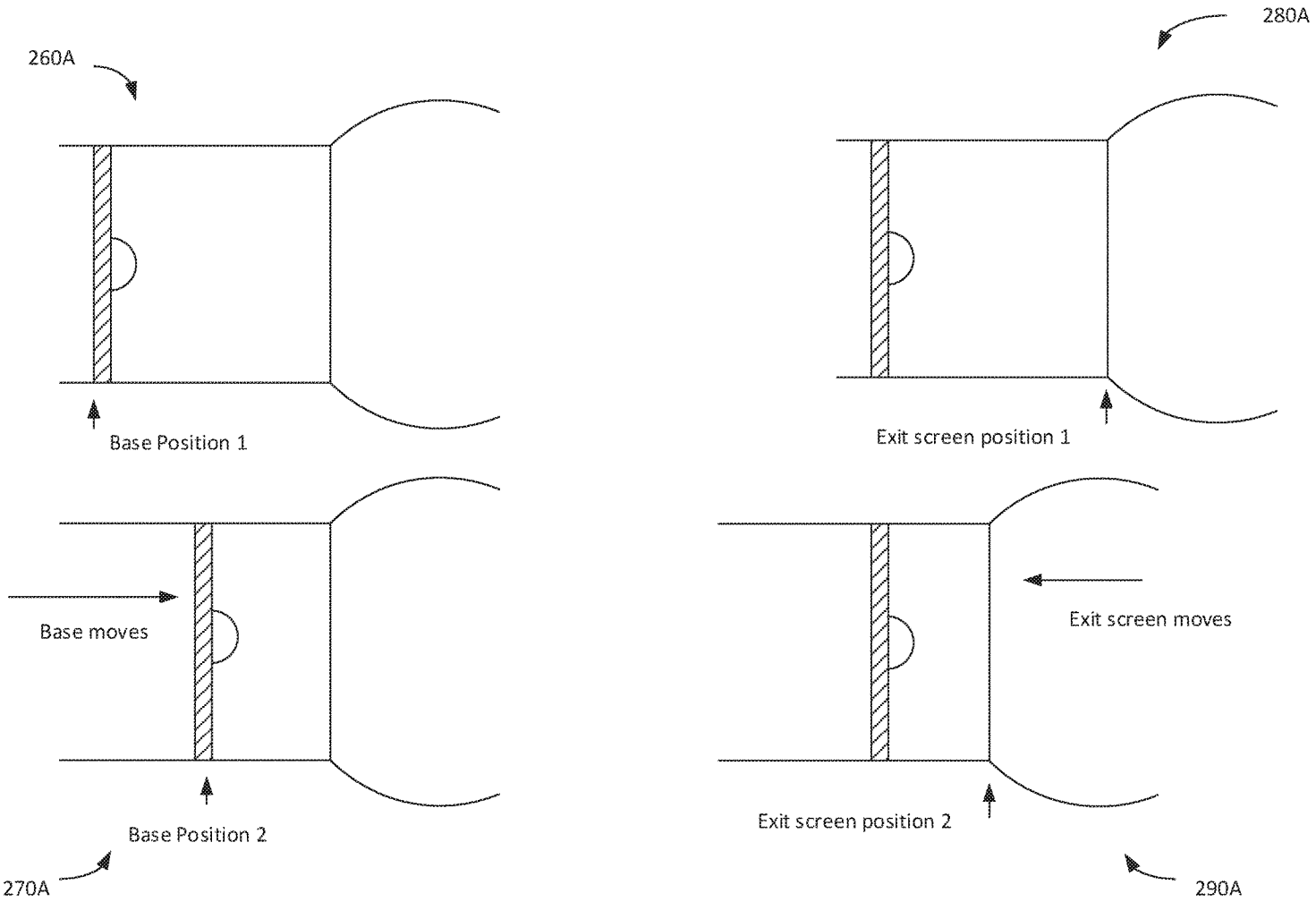
FIG. 2A shows side cross-section view of light mixing chambers with rigid walls in expanded and collapsed positions.

As previously mentioned, the LED-to-exit distance is adjustable, which allows for the variation in the output beam angle. The adjustment can be accomplished either by moving an adjustable base closer to a fixed exit screen, moving an adjustable exit screen closer to a fixed base, or moving both an adjustable base and an adjustable exit screen closer to each other. FIG. 2A shows embodiments of a design with a rectangular (as viewed from a side cross-section) mixing chamber with rigid side walls. The first view 260A shows the mixing chamber with a movable base at first base position 1, and the second view 270A shows the same chamber, but with the movable base at a second position 2, which is closer to the exit screen than position 1. As shown, the base moves along the inside of the rigid walls, and the exit screen and rigid walls remain in place. FIG. 2A also shows alternative embodiments of the mixing chamber on the right with a first view 280A and a second view 290A which have an exit screen and reflector that are fixed to each other, but which are movable in relation to a fixed base. Mixing chamber 280A is shown in an expanded position, and mixing chamber 290A is shown in a shortened position, with the exit screen and reflector moved closer to the fixed base. A number of physical structures may be used to accomplish the movement of the various sides within the chamber as described herein. For example, the mixing chamber may be constructed with inner and outer portions arranged like two nested paper cups, with the inner cup capable of moving back and forth within the outer cup.

Figure 2B:
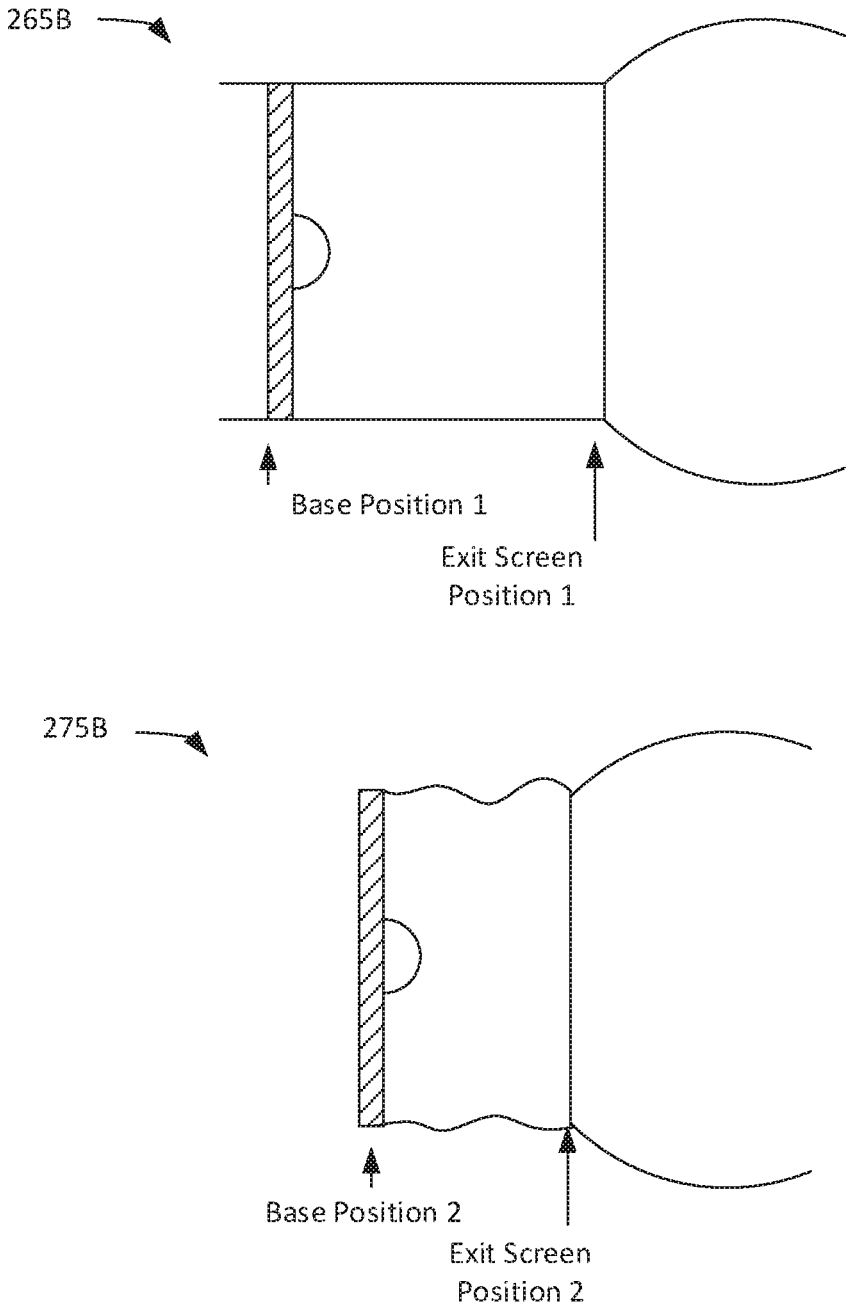
FIG. 2B shows a side cross-section view of a light mixing chamber with flexible walls in expanded and collapsed positions.
Figure 2C:
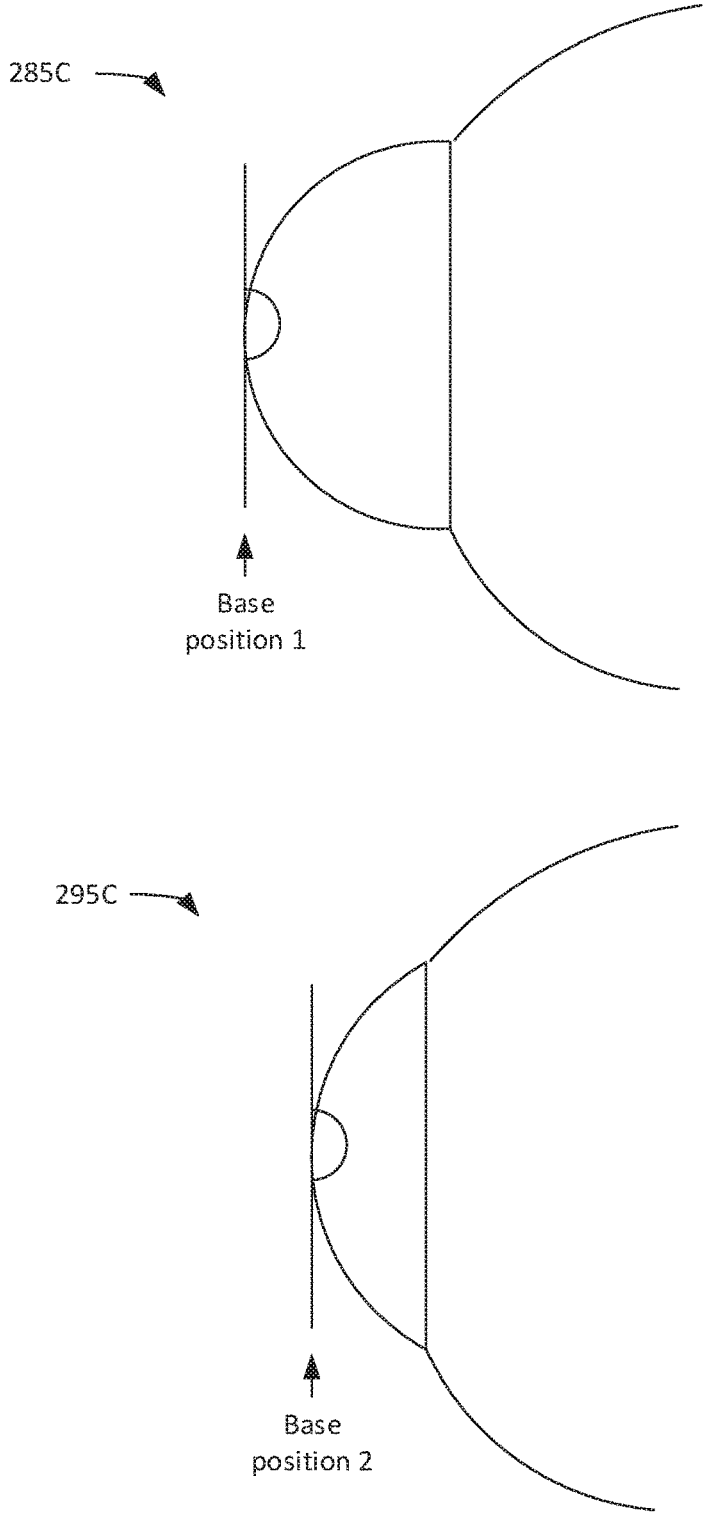
FIG. 2C shows a side cross-section view of a light mixing chamber with rounded, flexible walls in expanded and collapsed positions.

FIG. 2B shows a side view cross section of a mixing chamber with flexible, rather than rigid side walls. The first view 265B shows the chamber in a fully expanded position, and the second view 275A shows the chamber in a shortened (i.e., collapsed) position, with the flexible side walls folding somewhat to accommodate the shorter LED-to-exit distance. The flexible side walls may be constructed in a number of ways to specifically control how the side walls collapse or fold. These embodiments will be discussed in greater detail later in the disclosure. Alternatively, the mixing chamber may have a rounded shape with a single wall, forming a half-spherical shape, as shown in cross-section in FIG. 2C. The first view 285C shows the mixing chamber in a fully expanded position and the second view 295C shows the same chamber in a shortened of collapsed position. The embodiments shown in FIGS. 2B and 2C may have their flexible walls constructed like a bag, with the LED arrangement at the bottom and the exit screen at the top opening of the bag. The material may have elastic properties in some embodiments in order to provide uniformity in shape as the chamber expands and collapses. The embodiments of variable-distance mixing chambers shown herein are just a few examples of possible mixing chamber configurations. Any number of shapes may be used. For example, a mixing chamber may be polygonal with multiple wall segments.

The diffusing property of the transmissive screen 250 may be uniform thereacross or may vary from center to edge. In various embodiments, the screen is a diffusing material having an angle of distribution (i.e., the angle from the optical axis at which beam intensity is half of that along the optical axis) ranging from 30° to 55°; the optimum degree of diffusion of the screen depends on the height of the mixing chamber. Materials with appropriate degrees of diffusion that could be used in embodiments of the present disclosure include, for example, glass that is highly transparent, and textured plastic, though other materials may be used. For the purposes of the present disclosure, the "height" of the mixing chamber refers to the distance between the base and the exit screen. This measurement may also be referred to as an "LED-to-exit distance." Insufficient diffusion by the screen may cause undesirable images of the LEDs to form. For example, dark spots in between individual LEDs may become visible, or a dark circle in the middle of the light source may appear. At the same time, in an arrangement of multiple LEDs, varying the LED output intensity from the center outward can be exploited (by itself or in combination with a variable diffusing screen) to create a desired light distribution. For example, varying the LED output intensity can mimic the output of a halogen bulb. In one embodiment, LEDs at the central zone of an LED cluster may have a light output of 100 lumens or more (e.g., close to 250 lumens), while LEDs outside the center zone may have an output of only 25 lumens. The optimal size of the center zone varies with the application; in a working design, the center is about 4 $mm^2$ while the overall area of the focal plane is 380 $mm^2$. LEDs with different outputs may be used or the arrangement may consist of the same LEDs driven at different current levels. Therefore, various properties of transmissive screen diffusiveness and LED output intensity may be combined, in addition to varying the height of the light mixing chamber, in order to create the desired light output attributes from light sources in accordance with this disclosure.

Figure 3:
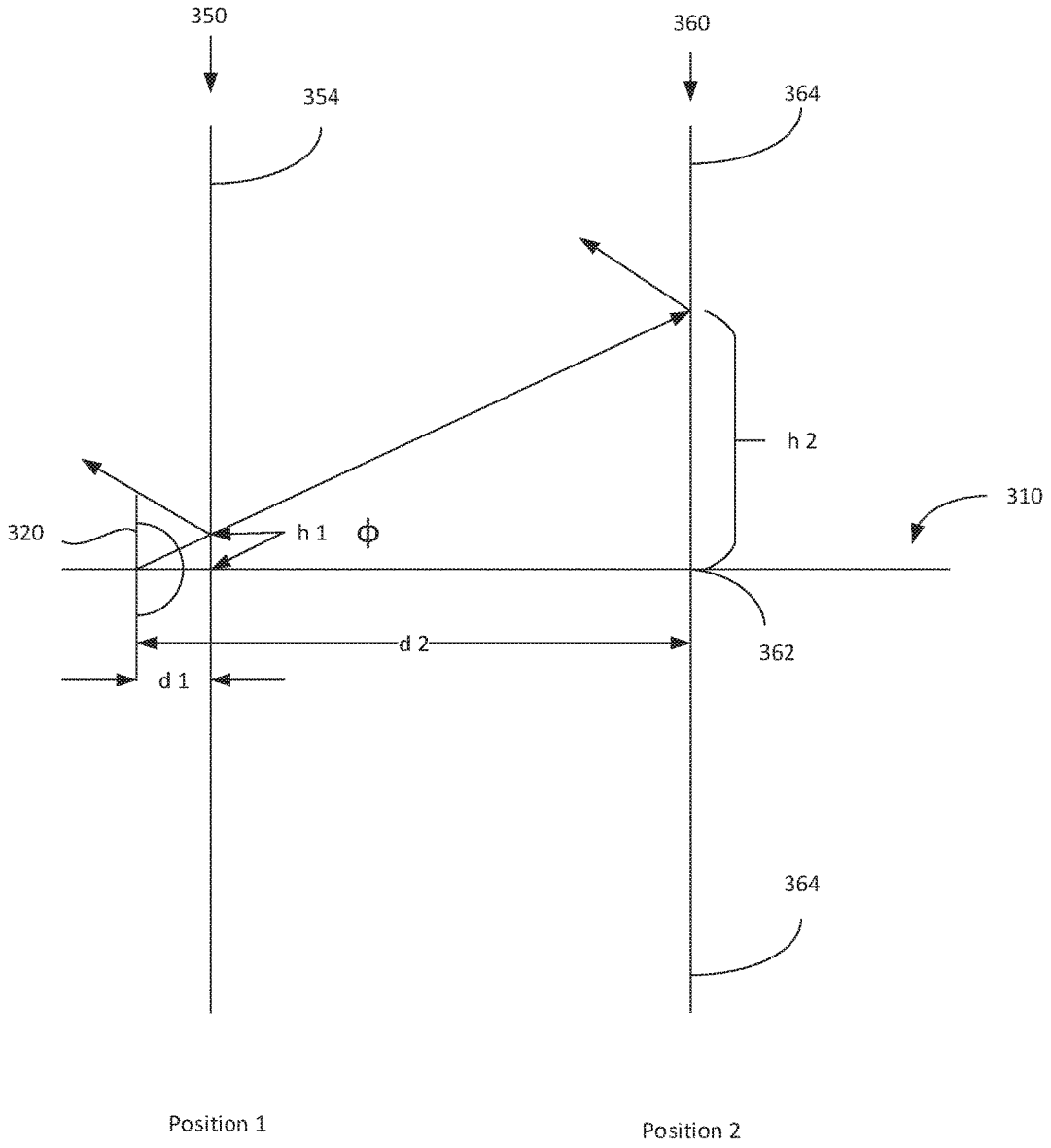
FIG. 3 is a diagram showing how a radius corresponding to an internal beam angle originating from an LED light increases as a distance from the LED to an exit screen increases.

The principle of operation of varying the chamber height is illustrated in FIG. 3. For simplicity, we consider two positions for a single LED 320 in relation to the transmissive exit screen to illustrate the effect on the internal beam angle. The beam angle discussed in FIG. 3 may be referred to as the "internal beam angle" because it refers to the angle of the beam produced by the LED within the light mixing chamber, as opposed to the angles of beams produced from the exit screen or from the end of the reflector. As previously stated, the output beam angle is the angle of light exiting the reflector. For the purposes of the present disclosure, the internal beam angle $\phi$ is chosen as a fixed angle that is measured at the angle for which the light intensity is half of the maximum light output at zero degrees.

FIG. 3 shows the transmissive exit screen which is shown at a closer position (position 1) and labeled 350 and a further position (position 2) labeled 360. Close proximity of the LED 320 to the transmissive exit screen at position 1 350 corresponds to an image of radius h1 produced on the exit screen given the internal beam angle $\phi$ and a separation distance labeled $d_1$. A large separation distance from the LED 320 to the transmissive exit screen at position 2 360 corresponds to an image of radius h2 (a larger radius than h1) given the same internal beam angle $\phi$ and larger separation distance labeled $d_2$.

Given the angle $\phi$ at which a ray travels, it can be seen that the projected light from the LED 320 occupies a narrow spot of radius $h_1$, when the LED-to-exit distance is $d_1$, and forms a much larger spot of radius $h_2$ when the distance is $d_2$. Because of the cosine distribution of the light shown in FIG. 1, the intensity decreases quickly from the center 362 to the edges 364 and 356 of the transmissive exit surface 360; but because the light is distributed over a greater surface area at distance $d_2$ than at distance $d_1$, the overall surface brightness that is created by the image on the transmissive exit screen is much lower when the transmissive screen is at position 2 360. As the LED-to-exit distance increases, the radius of the image (i.e., the "spot" of light created on the transmissive exit screen) also increases.

As previously stated, embodiments of the present disclosure provide a reflector coupled to the light mixing chamber, so various effects occur as a result of pairing a light mixing chamber with an adjustable LED-to-exit distance with different kinds of reflectors. Parabolic reflectors are one type of reflector shape commonly used with LED light sources. One property of a parabolic reflector (not shown in FIG. 3) is that it collimates light exiting from the exit screen. In embodiments of the present disclosure, the exit screen is located at the focus of the parabolic reflector; as a result of the location of the exit screen in relation to the parabolic reflector, the parabolic reflector only collimates the light emitted from the center point of the exit screen surface. Light outside the center point is sent at various angles away from the optical axis 310 and, therefore, a wider beam exiting the reflector is produced. The greater the LED-to-exit distance, the larger the image (i.e., spot) will be, and the less focused the image will be; as a result, more light will be off-center and not collimated, and the wider the beam exiting the reflector will be. This effect of the LED-to-exit distance (and therefore, the width of the beam) can be further enhanced by constructing the parabolic reflector in nested, concentric parabolic sections, wherein the angle of reflection is collimated (i.e., equal to zero) at the exit aperture of the reflector but which has an aiming angle that lies off the optical axis (i.e., is greater than zero) closest to the plane of focus (i.e., at the exit screen.) By using the nested, concentric parabolic sections, the degree of collimation can vary over the length of the entire reflector such that it has a large angle at the bottom (close to the transmissive exit screen) and a narrower angle at the top (at the exit aperture of the reflector). An off-axis aiming angle of approximately 25° for a parabolic reflector is found to be optimal in many applications. In many embodiments, the length of each nested parabolic section of the reflector will be less than or equal to the largest value of the radius h of the image.

Alternatively, an elliptical reflector (or series of concentric elliptical reflectors) may be used, as may other reflector shapes in a similar manner as a parabolic reflector, so long as the beam exit angle changes gradually enough from the focal plane to the top of the reflector. This gradual change in angle from the bottom of the reflector to the top would be accompanied by a loss of optical efficiency, rendering the device less useful, if it were not for the properties of the mixing chamber. Inevitably, a portion of the light from the LED striking the transmissive exit surface is reflected back into the mixing chamber. At position $d_2$, however, a larger fraction of the light originating from the LED strikes the reflecting wall(s) of the mixing chamber first than the fraction that strikes when the exit surface is at $d_1$. Because of the high reflectivity of the wall(s), any light that initially hits the reflective walls is reflected one or more times against the various surfaces of the mixing chamber until it eventually strikes the transmissive exit surface and leaves via the reflector. Hence, there is little loss in efficiency regardless of the position of the LED and beam angle when the interior walls of the mixing chamber are highly reflective. Computations taking account of the optical properties of the materials indicate a decrease in efficiency of only about 3% over the full range of beam angles and LED positions. Therefore, elliptical, parabolic, or other shaped reflectors may be used with a mixing chamber with highly reflective interior walls without much loss in efficiency.

Figure 1:
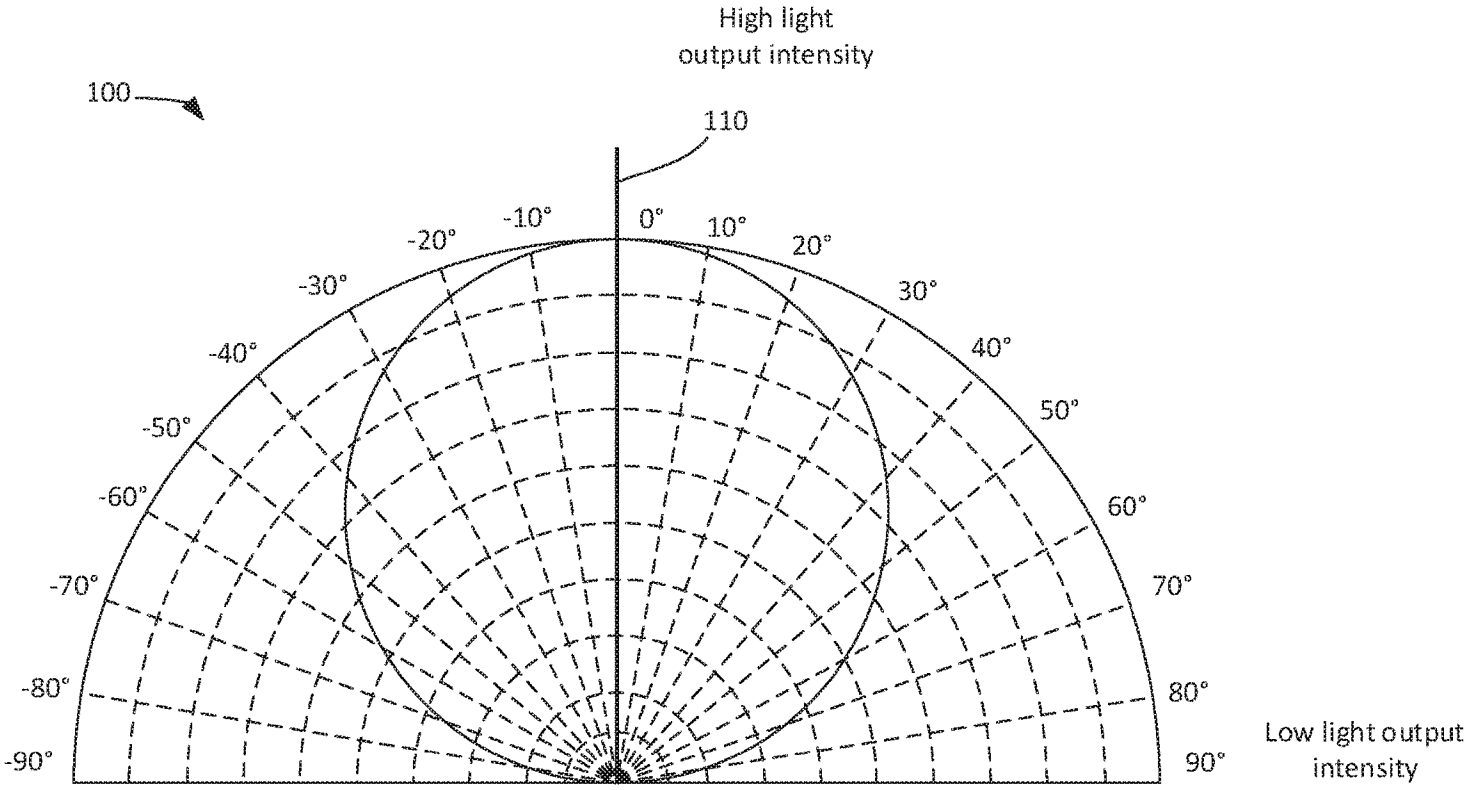
FIG. 1 shows a Lambertian distribution of light output intensity at various angles.
Figure 4B:
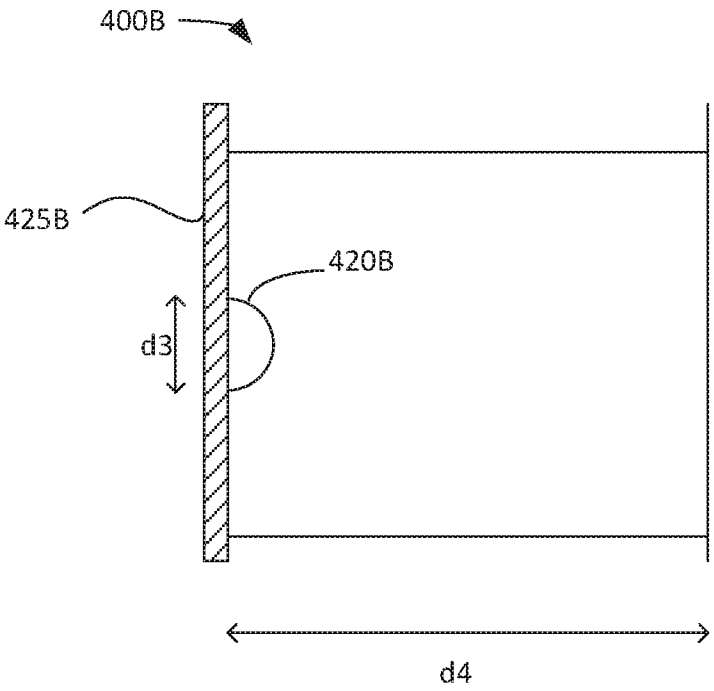
FIG. 4B shows a side view diagram of the LED arrangement of FIG. 4A in a mixing chamber, the mixing chamber having a particular distance from the LED to the exit screen.
Figure 4A:
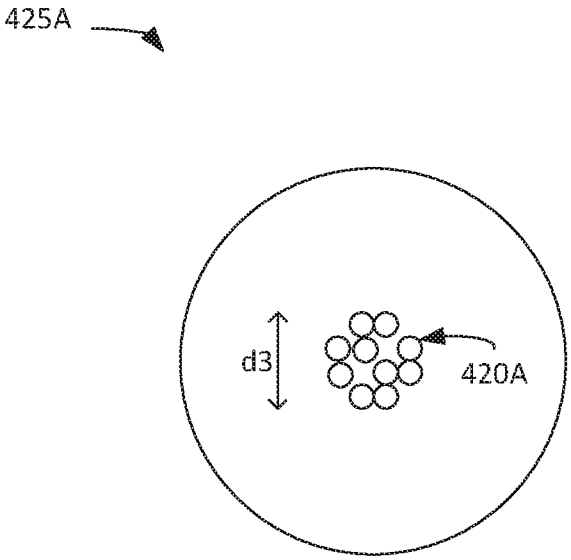
FIG. 4A shows a front view diagram of an LED arrangement having a particular diameter upon a base of a mixing chamber.

It is found that optimal performance of a light source of the present disclosure, as measured by efficiency of the light source and the widest range of potential output beam angles, occurs when the LED-to-exit screen distance is no greater than five times the diameter of a single LED or the diameter of multiple LEDs in an arrangement. The term "diameter," for the purposes of describing the dimensions of the light source, means the longest dimension of the LED arrangement, corresponding to the geometric diameter in the case of a circular pattern. FIG. 4A shows a front view of a base 425A and an LED arrangement 420A. As shown, the LED arrangement 420A has a diameter d3. FIG. 4B shows the base and LED arrangement of FIG. 4A in a side profile view within a light mixing chamber 400B. The LED arrangement 420B has the same diameter d3, and the LED-to-exit screen distance has a distance d4, which is approximately five times the diameter d3. A ratio greater than five to one wastes light from the LED because at such a great distance, too much light initially bounces off the walls, and only a small portion initially hits the exit screen, and there is very little light available near the plane of the LED (since the intensity falls off with the cosine of the emission angle). In other words, the light that is emitted from the angles furthest from the central optical axis (e.g., the light that is emitted at angles closest to the base upon which the LED sits) has a lower intensity than the light emitted closer to the central optical axis, as illustrated in FIG. 1. Therefore, at greater distances, a large amount of low-intensity light is reflected off of the walls of the mixing chamber. To limit adverse effects of this phenomenon, in certain embodiments of the present disclosure, the ratio of the LED-to-exit distance to the diameter of the LED light arrangement is exactly five to one. For example, in some embodiments, the diameter of an LED cluster is about 2 mm and the height of the chamber is 1 cm.

Figure 5:
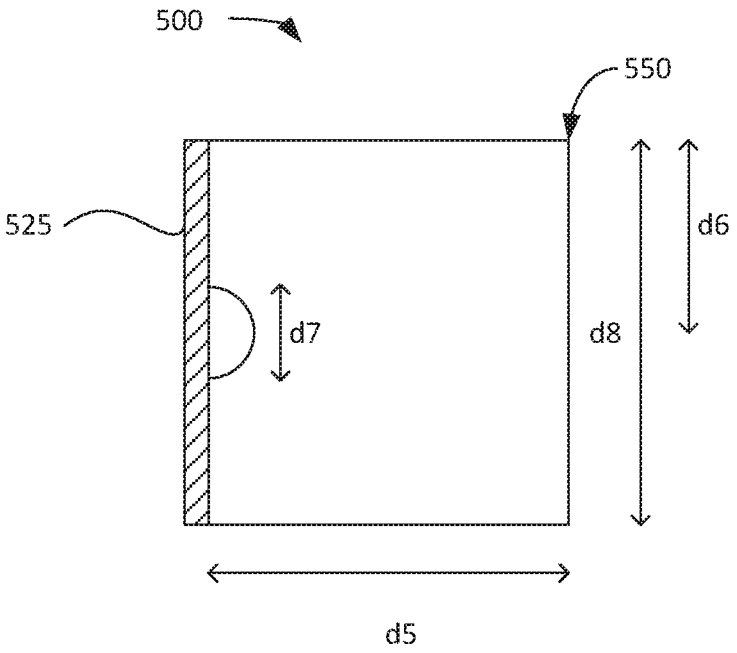
FIG. 5 shows a side view diagram of a light mixing chamber and particular distances of of its components.

In addition, the ratio of the LED-to-exit distance to the radius of the exit screen is desirably no greater than two to one. The term "radius," for the purpose of the present disclosure, means half the longest dimension of the exit screen, corresponding to the geometric radius in the case of a circular screen. FIG. 5 shows a light mixing chamber 500 with an exit screen 550. The exit screen 550 has a radius of distance d6. The light mixing chamber 500 has an LED-to-exit screen distance d5, which, as shown in FIG. 5, is approximately two times the distance d6. The ratio of the diameter of the LED arrangement, (shown as distance d7), to the diameter of the exit screen (shown as distance d8) determines the smallest achievable beam angle exiting the reflector. The larger the diameter of the LED, the larger the radius h (of the image) will be. If the diameter of the LED is too large, the radius h of the image will quickly equal the radius of the screen as the LED-to-exit distance increases, which limits how small the output beam angle can be. It is possible to make the minimum beam angle very small by altering various dimensions of the light source. For example, if the radius of the exit screen is made larger in comparison to the diameter of the LED, the output beam angle becomes smaller. The output beam angle can also be made smaller by increasing, in relation to the diameter of the LED, both the radius of the exit screen and also the size of the exit aperture of the reflector. In the limit, the minimum beam angle can be made infinitely small by making the entrance opening and the reflector infinitely large, thereby making the range achievable output angles also infinitely large.

Figure 6:
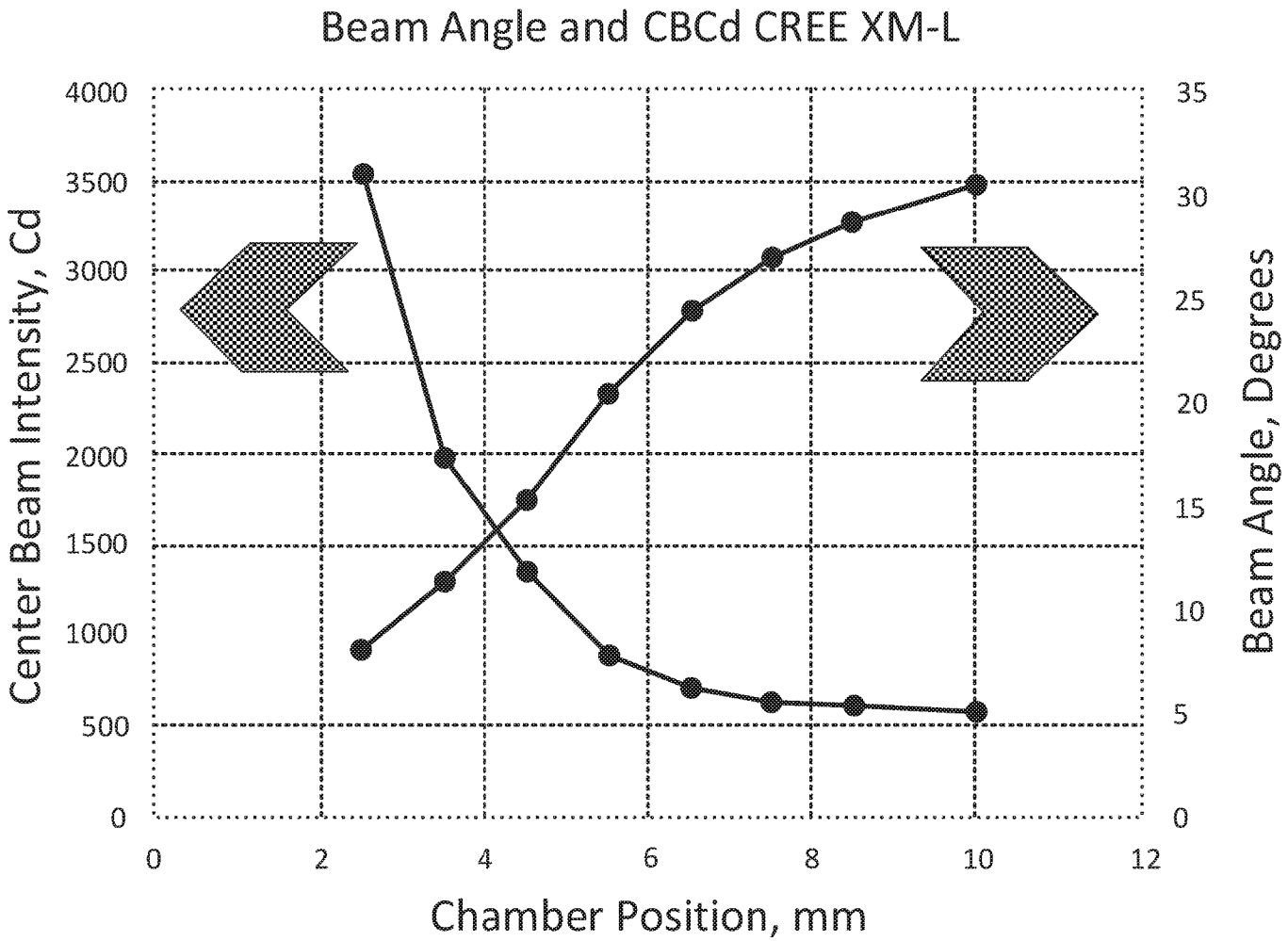
FIG. 6 is a graph depicting how as the LED-to-exit screen distance of the mixing chamber increases, the output beam angle increases and the center beam intensity decreases.

FIG. 6 illustrates the relationships between LED-to-exit distance ("chamber position") and (i) output beam angle and (ii) center output beam intensity based on geometric model calculations. As shown, the chamber position is plotted on the x-axis from zero to twelve mm. As the distance increases from just over 2 mm to just under 4 mm, the center beam intensity, plotted along the left y-axis and measured in candela, drops significantly from over 3500 Cd to approximately 2000 Cd. Over the same increase in chamber position, the output beam angle from the reflector, plotted on the right x-axis and measured in degrees, increases from approximately 8 degrees to approximately 12 degrees. As the chamber position increase from less than 4 m to over 6 mm, the center beam intensity continues to drop significantly, down to approximately 750 candela, and the beam angle continues to increase significantly, to approximately 20 degrees. As the chamber position is increased to 10 mm, the center beam intensity continues to drop, though not as drastically, to approximately 500 Cd, and the beam angle increases, though also not as drastically, to approximately 30 degrees.

Figure 7A:
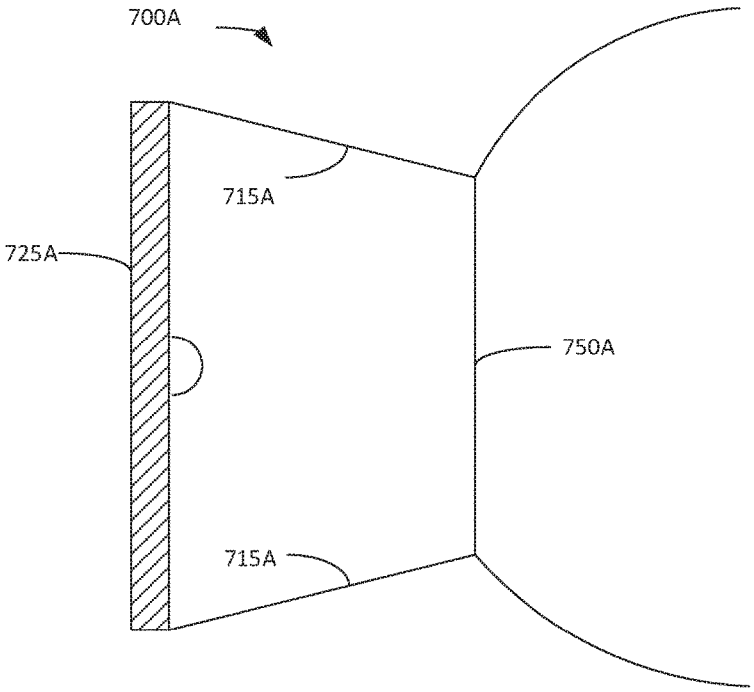
FIG. 7A shows a side view diagram of a light mixing chamber with flexible side walls in a fully expanded position and having a frusto-conical shape.
Figure 7B:
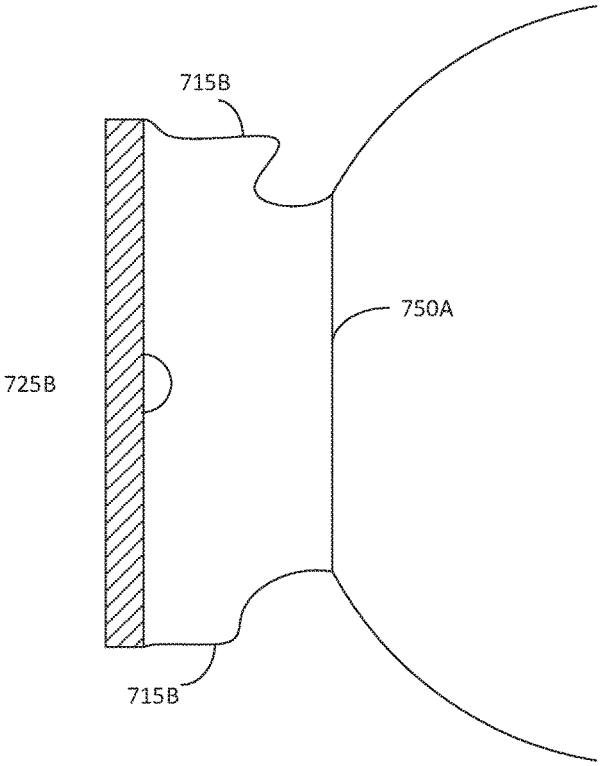
FIG. 7B shows a side view diagram of the light mixing chamber of FIG. 5A with the base and exit screen in a closer position and the flexible walls partially collapsed.

As previously discussed, either the base or the exit screen or both of the mixing chamber can be moved to vary the LED-to-exit distance. Since it is often required to mount the LED on a rigid metallic surface to enable the removal of heat by conduction, which limits the desirability of having the base itself be flexible, an aspect of the present disclosure provides a mixing chamber with reflecting walls that are flexible. A number of different types of materials may be utilized to fabricate flexible, reflective walls, including thin papers, metals, plastics, or films. Additionally, the flexible, reflective walls may form a variety of shapes, which themselves may further vary in shape depending on the relative positions of the LED base and the exit screen. A first representative implementation is shown in FIGS. 7A and 7B. In FIG. 7A, a mixing chamber 700A comprising a rigid base 725A, a transmissive exit screen 750A, and flexible walls 715A is shown in a fully expanded position. In this implementation, the mixing-chamber walls 715A is flexible and wider where it meets the base 725A than where it attaches to the exit screen 750A; this frusto-conical configuration permits ready mechanical collapse and expansion of the mixing chamber 700A. FIG. 7B shows the same mixing chamber shown in FIG. 7A, but in a configuration in which the distance between the base to the exit screen ceiling is less than its maximum distance. In FIG. 7B, either the base 725B or the exit screen 750A may be moved in order to reduce the LED-exit screen distance, and as a result, the flexible side walls 715B fold. In some instances, it may not be desirable for the flexible side walls to fold such that they fall inward within the mixing chamber, toward the center or toward the LED. This is because if the walls of the mixing chamber fold inward too much, they may block some light rays originating from the LED that would otherwise directly hit the exit screen without being reflected within the chamber first. An advantage of the frusto-conical shape shown in FIG. 7A is that by making the attachment point of the side walls 715A further away from the center of the LED, the flexible side wall material remains further away from the LED when the walls are collapsed. Still, it is contemplated that the highly reflective interior surface of the side walls will mitigate any adverse effects resulting from the folding of the walls into the chamber.

Figure 8A:
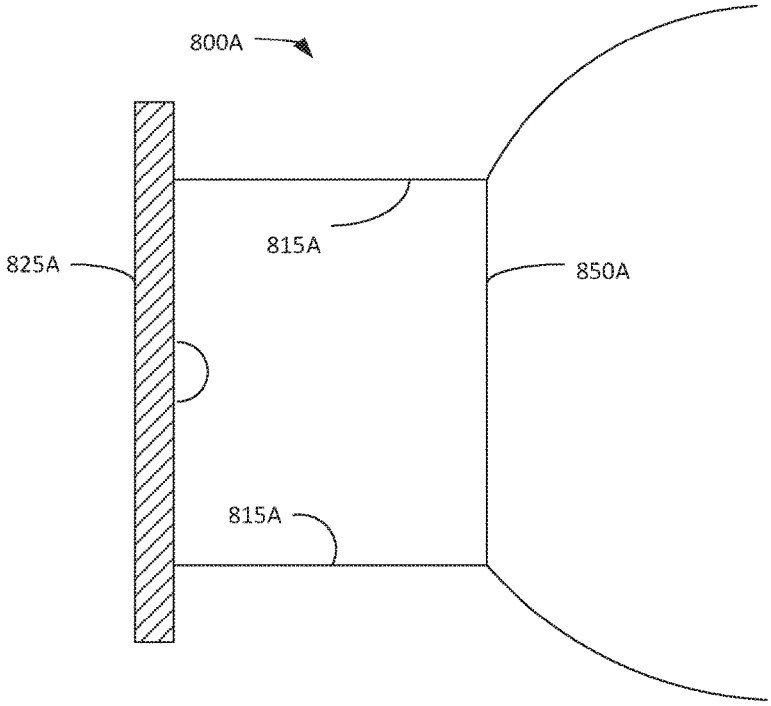
FIG. 8A shows a side view diagram of a light mixing chamber with flexible side walls with pleats in a fully expanded position and having a rectangular shape.
Figure 8B:
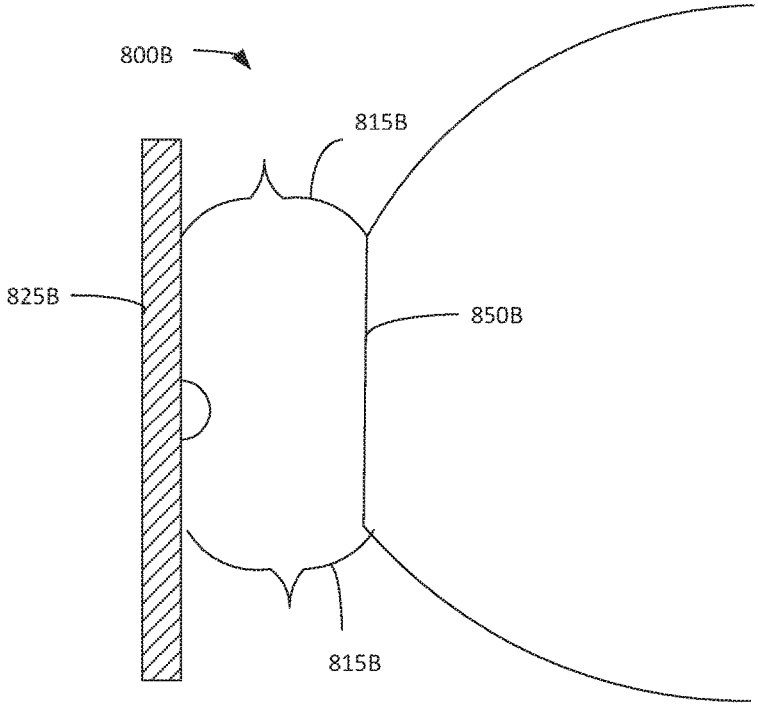
FIG. 8B shows a side view diagram of the light mixing chamber of FIG. 6A with the base and exit screen in a closer position, and the flexible walls with pleats folded outward and forming the shape of a bellows.

In another implementation, the flexible wall may have one or more pleats that causes the flexible walls to fold outwardly from the interior of the mixing chamber and form the shape of a bellows. As shown in FIG. 8A, a mixing chamber 800A may have a base 852A, an exit screen 850A, and flexible side walls 815A which form a rectangle when the LED-to-exit distance is at its maximum point. In FIG. 8B, when either the base 852B or the exit screen 850B is moved to reduce the LED-to-exit distance, the pleated side walls 815B fold outwards, forming a bellows. By implementing pleated side walls that fold outwardly, no extra material from the side wall may interfere with rays originating from the LED before they hit the exit screen. The examples shown in FIGS. 7A and 7B, and 8A and 8B are just two examples of shapes and configurations for variable-distance mixing chambers according to the present disclosure. Many other shapes are contemplated.

Figure 9:
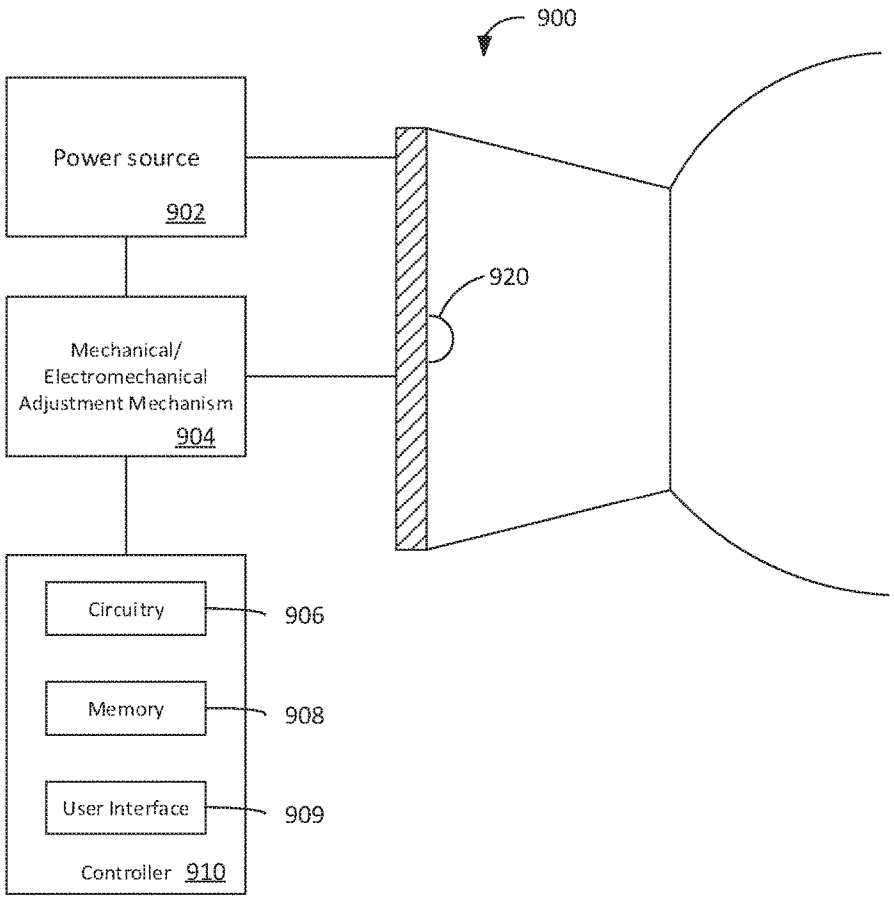
FIG. 9 is a logical block diagram of a light source coupled to a power source, an adjustment mechanism for varying the size of the light mixing chamber, and a controller for the adjustment mechanism.

In order to move either the base, the exit screen, or both, any suitable arrangement for causing relative movement between the mixing chamber floor and ceiling, using mechanical or electromechanical drive mechanisms, may be employed. For example, a mechanical linkage may be operated manually or via a motor such as a piezoelectric motor that requires little input power and occupies little space. FIG. 9 shows a logical block diagram of various components that may implement aspects of the variable-distance light mixing chamber. The diagram in FIG. 9 should not be construed as a hardware diagram, though various components may be implemented by hardware, software, or a combination of both. As shown, a light source 900 in accordance with the present disclosure is operatively connected to a power source 902 to provide power to the LED 920. The power source 902 may be connected to a mechanical or electromechanical adjustment mechanism 904. In some embodiments, if the adjustment mechanism 904 is electromechanical, the same power source 902 may supply power to both the LED and the drive mechanism 904. Alternatively, different power sources may be used for each.

In some embodiments, the height of the mixing chamber is controlled by a controller 910, with circuitry 906 programmed to move one or both of the base and the exit screen to achieve a desired beam divergence and/or center beam intensity of the light source. For example, based on the chart shown in FIG. 6, a programmable controller 910 can store, in a memory 908, the quantitative relationship between beam divergence and chamber height as a smooth curve. The controller 910 may also comprise a user interface 909 and respond to a user-supplied beam divergence value by adjusting the chamber height to produce the target beam divergence value in accordance with the curve. The same approach can be used for center beam intensity.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a reflector should be understood to encompass disclosure of the act of reflecting—whether explicitly discussed or not—and, conversely, were there only disclosure of the act of reflecting, such a disclosure should be understood to encompass disclosure of a "reflector mechanism". Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

The invention claimed is:

1. A light source producing a beam of variable divergence, the light source comprising:

one or more light-emitting devices arranged on a planar substrate, each of the light-emitting devices having a Lambertian emission distribution;

a chamber for mixing light emitted from the one or more light-emitting devices, the chamber comprising a base defined by the planar substrate, one or more side walls having a reflective interior surface, and a planar diffusive emission surface defining a ceiling of the chamber, the chamber having an adjustable height;

a reflector extending from the chamber for redirecting light exiting from the chamber to form a light beam, the reflector surrounding and having a focal plane coincident with the ceiling of the chamber, wherein the one or more side walls are flexible; and a mechanism to control a height of the chamber to thereby variably control a divergence of the light beam.

2. The light source of claim 1, wherein the one or more light-emitting devices are arranged in a pattern having a diameter, a ratio of the height of the chamber to the diameter of the pattern being no greater than five-to-one.

3. The light source of claim 1, wherein the one or more light-emitting devices are arranged in a pattern having a diameter and the base has a diameter, a ratio of the diameter of the base to the diameter of the pattern being at least five-to-one.

4. The light source of claim 1, wherein a ratio of the height of the chamber to a radius of the planar diffusive emission surface is no greater than two-to-one.

5. The light source of claim 1, wherein the reflector is parabolic or elliptic.

6. The light source of claim 1, wherein the reflector comprises a series of concentric, identically shaped sections having a collimated output at an exit aperture of the reflector and an off-axis aiming angle at the focal plane.

7. The light source of claim 6, wherein the off-axis aiming angle is approximately 25°.

8. The light source of claim 1, wherein the interior surface of the one or more side walls is diffusely reflective.

9. The light source of claim 1, wherein the interior surface of the one or more side walls is specularly reflective.

10. The light source of claim 1, wherein the one or more side walls comprises one or more pleats forming a bellows.

11. The light source of claim 1, wherein the mixing chamber has a frusto-conical profile when the mixing chamber is at a maximum height.

12. The light source of claim 1, wherein the mechanism to control the height of the chamber is mechanical.

13. The light source of claim 1, wherein the apparatus configured to control the height of the chamber is electromechanical.

14. The light source of claim 1, wherein the apparatus configured to control the height of the chamber comprises a memory for storing a quantitative relationship between beam divergence and chamber height, a user interface for receiving a user-supplied beam divergence value, and circuitry for adjusting the chamber height to produce the user-supplied beam divergence value.

15. The light source of claim 1, wherein the apparatus configured to control the height of the chamber comprises a memory for storing a quantitative relationship between center beam intensity and chamber height, a user interface for receiving a user-supplied center beam intensity value, and circuitry for adjusting the chamber height to produce the user-supplied center beam intensity value.

16. A light source, comprising:

one or more light-emitting devices arranged on a planar substrate;

a chamber for mixing light emitted from the one or more light-emitting devices, the chamber comprising a base defined by the planar substrate, one or more side walls having a reflective interior surface, and a planar diffusive emission surface defining a ceiling of the chamber, wherein the base is movable in relation to the ceiling, wherein the one or more side walls are flexible;

a reflector extending from the chamber for redirecting light exiting from the chamber to form a light beam, the reflector surrounding and having a focal plane coincident with the ceiling of the chamber.

17. An adjustable light source for producing a light beam of variable divergence, the light source comprising:

one or more light-emitting devices arranged on a reflective substrate, a chamber for mixing light emitted from the one or more light-emitting devices, the chamber comprising a base defined by the reflective substrate, one or more side walls having a reflective and flexible interior surface, and a diffusive emission surface defining a ceiling of the chamber, wherein the distance between the base and the ceiling is adjustable, a reflector extending from the chamber for redirecting light exiting from the chamber to form a light beam, the reflector surrounding and having a focus coincident with the ceiling of the chamber; and a mechanism for adjusting the distance between the base and the ceiling, wherein adjusting the distance changes the divergence of the light beam.

* * * * *